US007210439B2

(12) United States Patent
Geyer et al.

(10) Patent No.: US 7,210,439 B2
(45) Date of Patent: May 1, 2007

(54) SWITCHING ELEMENT FOR A VALVE TRAIN OF AN INTERNAL COMBUSTION ENGINE

(75) Inventors: Norbert Geyer, Hochstadt (DE); Peter Sailer, Erlangen (DE); Oliver Schnell, Veitsbronn (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/415,074

(22) Filed: May 2, 2006

(65) Prior Publication Data

US 2006/0191503 A1 Aug. 31, 2006

Related U.S. Application Data

(62) Division of application No. 10/498,481, filed as application No. PCT/EP03/00307 on Jan. 15, 2003.

(60) Provisional application No. 60/354,628, filed on Feb. 6, 2002.

(30) Foreign Application Priority Data

Feb. 6, 2002 (DE) ..... 102 04 672

(51) Int. Cl.
*F01L 1/14* (2006.01)

(52) U.S. Cl. ..... 123/90.55; 123/90.48; 123/90.5; 123/90.52

(58) Field of Classification Search ..... 123/90.55
See application file for complete search history.

(56) References Cited

U.S. PATENT DOCUMENTS

| | | | | |
|---|---|---|---|---|
| 3,108,580 | A | 10/1963 | Crane | 123/90 |
| 3,886,808 | A | 6/1975 | Weber | 74/569 |
| 4,054,109 | A | 10/1977 | Herrin et al. | 123/90.16 |
| 4,083,334 | A | 4/1978 | Roncon | 123/90.35 |
| 4,089,234 | A | 5/1978 | Henson et al. | 74/569 |
| 4,098,240 | A | 7/1978 | Abell | 123/90.55 |
| 4,133,332 | A | 1/1979 | Benson et al. | 123/198 F |
| 4,164,917 | A | 8/1979 | Glasson | 123/321 |
| 4,207,775 | A | 6/1980 | Lintott | 74/55 |

(Continued)

FOREIGN PATENT DOCUMENTS

DE 42 06 166 A1 9/1992

(Continued)

OTHER PUBLICATIONS

Quan Zheng, "Characterization of the Dynamic Response of a Cylinder Deactivation Valvetrain System," Society of Automotive Engineers, Inc., SAE Technical Paper Series, Mar. 2001, pp. 195-201.

(Continued)

*Primary Examiner*—Thomas Denion
*Assistant Examiner*—Kyle M. Riddle
(74) *Attorney, Agent, or Firm*—Fitzpatrick, Cella, Harper & Scinto

(57) ABSTRACT

The invention proposes a switching element (1) for a valve train of an internal combustion engine, particularly for valve deactivation, with a simple-to-implement measure for adjusting the coupling lash of its coupling means (8) in a receptacle (6) using two retaining rings (19, 20), one of which is stocked in a variety of thicknesses.

32 Claims, 1 Drawing Sheet

U.S. PATENT DOCUMENTS

| | | | | |
|---|---|---|---|---|
| 4,228,771 | A | 10/1980 | Krieg | 123/90.55 |
| 4,231,267 | A | 11/1980 | Van Slooten | 74/569 |
| 4,386,806 | A | 6/1983 | Axen et al. | 299/5 |
| 4,463,714 | A | 8/1984 | Nakamura | 123/90.57 |
| 4,546,734 | A | 10/1985 | Kodama | 123/90.16 |
| 4,576,128 | A | 3/1986 | Kenichi | 123/128 |
| 4,615,307 | A | 10/1986 | Kodama et al. | 123/90.16 |
| 4,739,675 | A | 4/1988 | Connell | 74/569 |
| 4,768,475 | A | 9/1988 | Ikemura | 123/90.16 |
| 4,790,274 | A | 12/1988 | Inoue et al. | 123/198 F |
| 4,905,639 | A | 3/1990 | Konno | 123/90.16 |
| 4,913,106 | A | 4/1990 | Rhoads | 123/90.49 |
| 4,941,438 | A | 7/1990 | Muto | 123/90.46 |
| 4,942,855 | A | 7/1990 | Muto | 123/90.33 |
| 5,085,182 | A | 2/1992 | Nakamura et al. | 123/90.16 |
| 5,088,455 | A | 2/1992 | Moretz | 123/90.5 |
| 5,090,364 | A | 2/1992 | McCarroll et al. | 123/90.16 |
| 5,099,806 | A | 3/1992 | Murata et al. | 123/90.16 |
| 5,245,958 | A | 9/1993 | Krieg et al. | 123/90.55 |
| 5,247,913 | A | 9/1993 | Manolis | 123/90.16 |
| 5,253,621 | A | 10/1993 | Dopson et al. | 123/90.16 |
| 5,255,639 | A | 10/1993 | Shirey et al. | 123/90.16 |
| 5,261,361 | A | 11/1993 | Speil | 123/90.22 |
| 5,307,769 | A * | 5/1994 | Meagher et al. | 123/90.5 |
| 5,345,904 | A | 9/1994 | Dopson et al. | 123/198 F |
| 5,351,662 | A | 10/1994 | Dopson et al. | 123/90.16 |
| 5,357,916 | A | 10/1994 | Matterazzo | 123/90.16 |
| 5,361,733 | A | 11/1994 | Spath et al. | 123/90.16 |
| 5,398,648 | A | 3/1995 | Spath et al. | 123/90.16 |
| 5,402,756 | A | 4/1995 | Bohme et al. | 123/90.16 |
| 5,419,290 | A | 5/1995 | Hurr et al. | 123/90.16 |
| 5,429,079 | A | 7/1995 | Murata et al. | 123/90.16 |
| 5,431,133 | A | 7/1995 | Spath et al. | 123/90.16 |
| 5,501,186 | A | 3/1996 | Hara et al. | 123/90.16 |
| 5,544,626 | A | 8/1996 | Diggs et al. | 123/90.16 |
| 5,544,628 | A | 8/1996 | Voigt | 123/90.16 |
| 5,546,899 | A | 8/1996 | Sperling et al. | 123/90.5 |
| 5,555,861 | A | 9/1996 | Mayr et al. | 123/90.16 |
| 5,615,651 | A | 4/1997 | Miyachi | 123/198 F |
| 5,651,335 | A | 7/1997 | Elendt et al. | 123/90.16 |
| 5,655,487 | A | 8/1997 | Maas et al. | 123/90.16 |
| 5,660,153 | A | 8/1997 | Hampton et al. | 123/90.16 |
| 5,669,342 | A | 9/1997 | Speil | 123/90.16 |
| 5,682,848 | A | 11/1997 | Hampton et al. | 123/90.16 |
| 5,709,180 | A | 1/1998 | Spath | 123/90.16 |
| 5,720,244 | A | 2/1998 | Faria | 123/90.16 |
| 5,782,216 | A | 7/1998 | Haas et al. | 123/90.16 |
| 5,803,040 | A | 9/1998 | Biesinger et al. | 123/198 F |
| 5,832,884 | A | 11/1998 | Haas et al. | 123/90.16 |
| 5,875,748 | A | 3/1999 | Haas et al. | 123/90.16 |
| 5,893,344 | A | 4/1999 | Church | 123/90.16 |
| 5,934,232 | A | 8/1999 | Greene et al. | 123/90.16 |
| 6,032,643 | A | 3/2000 | Hosaka et al. | 123/321 |
| 6,053,133 | A | 4/2000 | Faria et al. | 123/90.16 |
| 6,076,491 | A | 6/2000 | Allen | 123/90.16 |
| 6,092,497 | A | 7/2000 | Preston et al. | 123/90.16 |
| 6,095,696 | A | 8/2000 | Foldi | 385/79 |
| 6,164,255 | A | 12/2000 | Maas et al. | 123/90.16 |
| 6,196,175 | B1 | 3/2001 | Church | 123/90.16 |
| 6,213,076 | B1 | 4/2001 | Fischer et al. | 123/90.55 |
| 6,244,229 | B1 | 6/2001 | Nakano et al. | 123/90.15 |
| 6,247,433 | B1 | 6/2001 | Faria et al. | 123/90.16 |
| 6,257,185 | B1 | 7/2001 | Groh et al. | 123/90.16 |
| 6,273,039 | B1 | 8/2001 | Church | 123/90.16 |
| 6,318,324 | B1 | 11/2001 | Koeroghlian et al. | 123/90.55 |
| 6,321,704 | B1 | 11/2001 | Church et al. | 123/90.16 |
| 6,321,705 | B1 | 11/2001 | Fernandez et al. | 123/90.16 |
| 6,325,030 | B1 | 12/2001 | Spath et al. | 123/90.16 |
| 6,345,596 | B1 | 2/2002 | Kuhl | 123/90.16 |
| 6,405,699 | B1 | 6/2002 | Church | 123/90.5 |
| 6,412,460 | B1 | 7/2002 | Sato et al. | 123/90.16 |
| 6,427,652 | B2 | 8/2002 | Faria et al. | 123/90.16 |
| 6,439,176 | B1 | 8/2002 | Payne | 123/90.12 |
| 6,460,499 | B1 | 10/2002 | Mason et al. | 123/90.55 |
| 6,477,997 | B1 | 11/2002 | Wakeman | 123/90.16 |
| 6,497,207 | B2 | 12/2002 | Spath et al. | 123/90.16 |
| 6,513,470 | B1 | 2/2003 | Hendriksma et al. | 123/90.16 |
| 6,578,535 | B2 | 6/2003 | Spath et al. | 123/90.16 |
| 6,588,394 | B2 | 7/2003 | Zheng et al. | 123/198 F |
| 6,591,796 | B1 | 7/2003 | Scott | 123/90.13 |
| 6,595,174 | B2 | 7/2003 | Schnell | 123/90.55 |
| 6,606,972 | B2 | 8/2003 | Wenisch et al. | 123/90.17 |
| 6,615,783 | B2 | 9/2003 | Haas et al. | 123/90.48 |
| 6,655,487 | B2 | 12/2003 | Mallette et al. | 180/190 |
| 6,668,776 | B2 | 12/2003 | Hendriksma et al. | 123/90.16 |
| 6,745,737 | B2 | 6/2004 | Evans et al. | 123/90.5 |
| 6,748,914 | B2 | 6/2004 | Spath et al. | 123/90.48 |
| 6,802,288 | B2 | 10/2004 | Spath | 123/90.16 |
| 6,814,040 | B2 | 11/2004 | Hendriksma et al. | 123/90.59 |
| 6,866,014 | B2 | 3/2005 | Spath | 123/90.5 |
| 6,920,857 | B2 | 7/2005 | Spath | 123/90.48 |
| 6,976,463 | B2 | 12/2005 | Spath et al. | 123/90.59 |
| 6,997,154 | B2 | 2/2006 | Geyer et al. | 123/90.44 |
| 7,007,651 | B2 | 3/2006 | Spath | 123/90.5 |
| 2001/0009145 | A1 | 7/2001 | Faria et al. | 123/90.16 |
| 2002/0038642 | A1 | 4/2002 | Haas et al. | 123/90.48 |
| 2002/0195072 | A1 | 12/2002 | Spath et al. | 123/90.16 |
| 2003/0070636 | A1 | 4/2003 | Evans et al. | 123/90.5 |
| 2003/0075129 | A1 | 4/2003 | Spath et al. | 123/90.16 |
| 2003/0101953 | A1 | 6/2003 | Hendriksma et al. | 123/90.16 |
| 2005/0081811 | A1 | 4/2005 | Spath et al. | 123/90.48 |
| 2005/0103300 | A1 | 5/2005 | Spath et al. | 123/90.59 |
| 2006/0219199 | A1 | 10/2006 | Geyer et al. | 123/90.58 |

FOREIGN PATENT DOCUMENTS

| | | | |
|---|---|---|---|
| DE | 43 32 660 | A1 | 3/1995 |
| DE | 43 33 927 | A1 | 4/1995 |
| DE | 198 04 952 | A1 | 8/1999 |
| DE | 199 15 531 | A1 | 10/2000 |
| DE | 199 15 532 | A1 | 10/2000 |
| DE | 199 19 245 | A1 | 11/2000 |
| EP | 0 318 151 | A1 | 5/1989 |
| EP | 0 608 925 | B1 | 8/1994 |
| EP | 1 149 989 | A1 | 10/2001 |
| GB | 574 852 | A | 1/1946 |
| GB | 2 272 022 | | 5/1994 |
| WO | WO 9530081 | A1 | 11/1995 |

OTHER PUBLICATIONS

K. Hampton, Eaton VRRS System, Society of Automotive Engineers, Inc., Variable Value Actuation TOPTEC® : The State of the Art, Sep. 11-12, 2000, 25 pages.

Buuk, B. et al., "Engine Trends and Valve Train Systems for Improved Performance and Fuel Economy", Eaton Corporation—Engine Components Operations, USA, pp. 1-9 (Aug. 1999).

Fortnagel, M. et al., "Four Made of Eight—The New 4.31 and 5.01 V8 Engines", Mercedes-Benz S-Class, pp. 58-62 (1997).

Sandford, M. et al., "Reduced Fuel Consumption and Emissions Through Cylinder Deactivation", Aachener Kolloquium Fahrzeug- und Motorentechnik, pp. 1017-1027 (1998).

Chrysler Group, "Design Practice Standards", Paper dated Mar. 15, 2005, 1 page, in German with English Translation (2 pages).

* cited by examiner

SWITCHING ELEMENT FOR A VALVE TRAIN OF AN INTERNAL COMBUSTION ENGINE

This application is a divisional of U.S. application Ser. No. 10/498,481, which is a National Stage filing under 35 U.S.C. § 371 of International Application No. PCT/EP03/00307, filed Jan. 15, 2003, which in turn claims priority of both German Application No. DE 102 04 672.7, filed Feb. 6, 2002, and U.S. Provisional Patent Application No. 60/354,628, filed Feb. 6, 2002, the priorities of each of which is hereby claimed, said International Application having been published in German, but not in English, as International Publication No. WO 03/067038 A1.

BACKGROUND OF THE INVENTION

1. Field of the Invention

The invention concerns a switching element for a valve train of an internal combustion engine, preferably for valve deactivation, having an outer part and an inner element that is axially displaceable in a bore therein, wherein the outer part and the inner element each have at least one receptacle aligned with each other in an axially separated relative position achieved by a lost motion spring, wherein one or more movable coupling means for coupling the inner element with the outer part are applied in one of the receptacles toward the other receptacle in their positions relative to one another, wherein a first upper stop for defining the relative position is applied between the inner element and the outer part, and wherein a hydraulic lash adjuster with a pressure piston is installed in the inner element, which pressure piston is fixed against moving axially out of the inner element by a second upper stop.

2. Description of the Related Art

A switching element of this type is disclosed in DE 199 15 531 that is considered generic. This switching element is shown as a switchable cam follower for a tappet push rod drive. An upper stop for defining the relative position is realized through a piston-like element arranged in the inner element. This piston-like element projects radially outward into a longitudinal groove of the outer part. In the axially extended state of the inner element relative to the outer part, the piston-like element contacts an end of the longitudinal groove. The aim of this is to achieve an aligned positioning of a coupling bore provided in the outer part and a piston arranged in the inner element for coupling.

A drawback of this prior art is that adjustment of lash in the coupling is relatively complicated and expensive. It is clear that the receptacle in the outer part (here a coupling bore) for receiving the piston must be designed with a slight lash relative to the outer peripheral surface of the piston. This lash and a vertical-position vary from one switching element to the other depending on the manufacturing conditions. The relatively broad range of variation of this mechanical free travel in the switching elements is, however, not desirable.

Therefore, to adjust the coupling lash or keep its variance within an acceptable range, the pistons are classified for locking purposes in groups. This is extremely complicated and expensive from the manufacturing and measuring point of view. For example, switching elements must be completely assembled, the lash then measured, following which the switching element must again be disassembled and mated to a suitable coupling piston. It is equally conceivable to classify the upper stops on the longitudinal groove of the outer element.

Another upper stop is provided in the aforesaid prior art for a pressure piston of the lash adjuster and is configured as a ring.

If two pistons are provided for coupling, as is the case in DE 4,206,166, the aforesaid stop-measures prove to be nearly impossible. The aligned position of the coupling bores situated diametrically opposite each other in the inner element is realized when the two axially movable parts of the switching element make contact with the base circle of the cam. An adjustment of the coupling lash in this case is accomplished by extremely complicated manufacturing and measuring techniques by pairing suitable switching elements (in this case, cup tappets) with cam pairs or camshafts. Under certain circumstances, it is necessary to tolerate an excessive lash variation.

Thus, the object of the invention is to provide a switching element of the aforementioned type in which the stated drawbacks are eliminated by simple means.

SUMMARY OF THE INVENTION

This object is achieved in accordance with the invention in that each of the upper stops is designed as at least one annular element such as a retaining ring and the upper stops are arranged on top of each other in the bore of the outer part, wherein as seen when looking into the bore of the outer part, the lower retaining ring forms the second upper stop and the first retaining ring, located above it, forms the first upper stop, wherein variable-thickness first retaining rings and constant-thickness second retaining rings are provided at assembly of the retaining rings, and wherein the retaining ring stack contacts a stop such as an annular shoulder of the bore with the first retaining ring out of the bore.

Due to the at least two, or two retaining rings, as the case may be, a simple, tilt-free and adjustable upper stop and, at the same time, a safety device against loss of the pressure piston of the hydraulic-lash adjuster is obtained. Preferably, two coupling means (pistons) are provided in the inner element. However, the invention applies equally to embodiments with only one piston or with a plurality of pistons.

The aforementioned means overcome the aforesaid drawbacks by simple means and effectively. On the one hand, it is ensured that the pressure piston of the lash adjuster and thus also the inner element cannot be lost (second upper stop) during the assembly of the switching element. On the other hand, the stocking of variable-thickness first rings as first upper stops is a very simple option for adjusting the free travel of the at least one coupling element (piston) relative to its surrounding receptacle. This free travel is preferably adjusted such that each receptacle surrounds the relevant coupling element with equal spacing in both axial directions. If the receptacle is a bore and not an annular groove, it is particularly advantageous if the bore surrounds the relevant coupling element concentrically.

In place of the retaining rings here, a person skilled in the art will conceive of other easy-to-install stop elements such as discs, insertable pins, wedges, rings, etc. Of course, these elements may also be arranged at other height levels than on the edge of the switching element. If need be, a plurality of retaining rings can be paired to realize the coupling lash or the anti-loss device.

It is thus guaranteed that, in the relevant coupling situation, the coupling means of a large number of switching elements will always traverse the same free travel in the surrounding receptacle of the outer part.

As mentioned above, the coupling means is provided preferably in the form of two pistons that extend in the receptacle, designed as a radial bore, in the inner element where they are situated diametrically opposite each other. This is a particularly tilt-resistant mechanism that produces only a slight component loading when coupled. In place of the radial bore in the inner element, it is also conceivable to use a blind bore or another similar feature.

As a further development of the invention it is proposed, as already mentioned, to manufacture the receptacle of the outer part in the form of an annular groove in its bore. This is particularly advantageous from the manufacturing point of view. Bores may also be used in place of the annular groove.

According to a further advantageous embodiment of the invention, the inner element is secured against rotation relative to the outer part, for instance by a pin-like element. In this way, the coupling means has the same position relative to its receptacle over the entire operating life of the switching element as at the adjustment of the coupling lash. As a result, tolerances no longer have any effect when the receptacle is configured as an annular groove.

It is further proposed in the case where two pistons are used as a coupling means, to have the annular groove intersected by two diametrically opposite oil passages such as bores. If two ducts situated opposite each other are provided for the switching element in an oil gallery of a surrounding structure, for example, a cylinder head or a guide for the switching element connected to the internal combustion engine, it is of no importance which oil passage of the switching element communicates with which duct. What is important for achieving the same switching times is that the oil paths have the same length. However, if there is only one duct, a properly oriented installation of the switching element is required. In this case, appropriate markings can be provided on the switching element to facilitate assembly. Of course, the oil passages in the outer part may also be arranged on another peripheral portion of the outer part so that they are not aligned to the pistons in the coupled state.

In the event that the switching element is manufactured as a cam follower in a tappet push rod drive, as proposed in another useful further development of the invention, and this cam follower has a roller as a cam-contacting element, it is necessary, also for a correct allocation of the ducts from the ambient structure to the oil passages, to secure the switching element against rotation. Appropriate anti-rotation devices such as flattened portions on the outer peripheral surface of the outer part are proposed in this connection.

Other elements such as latches, balls, wedges or similar elements that produce a positive engagement may also be used as a coupling means in place of the pistons. If necessary, a combination of positive engagement and force-locking is also feasible.

The scope of protection of this invention extends explicitly to all kinds of switching elements in valve trains such as the aforesaid cam followers in tappet push rod drives, cup tappets or support elements for drag levers, etc.

BRIEF DESCRIPTION OF THE DRAWINGS

The invention will now be explained more closely with reference to the drawing in which.

DETAILED DESCRIPTION

Figure 1:
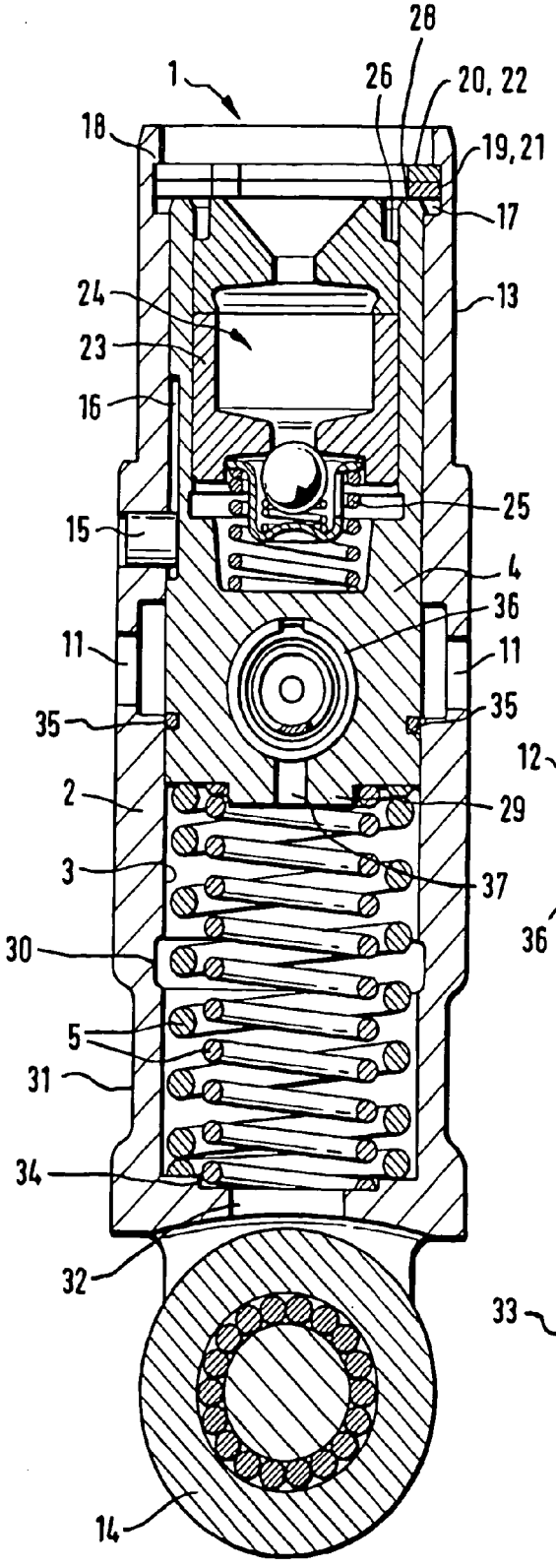
FIG. 1 shows a longitudinal section through a switching element embodied as a roller tappet for a tappet push rod drive.
Figure 2:
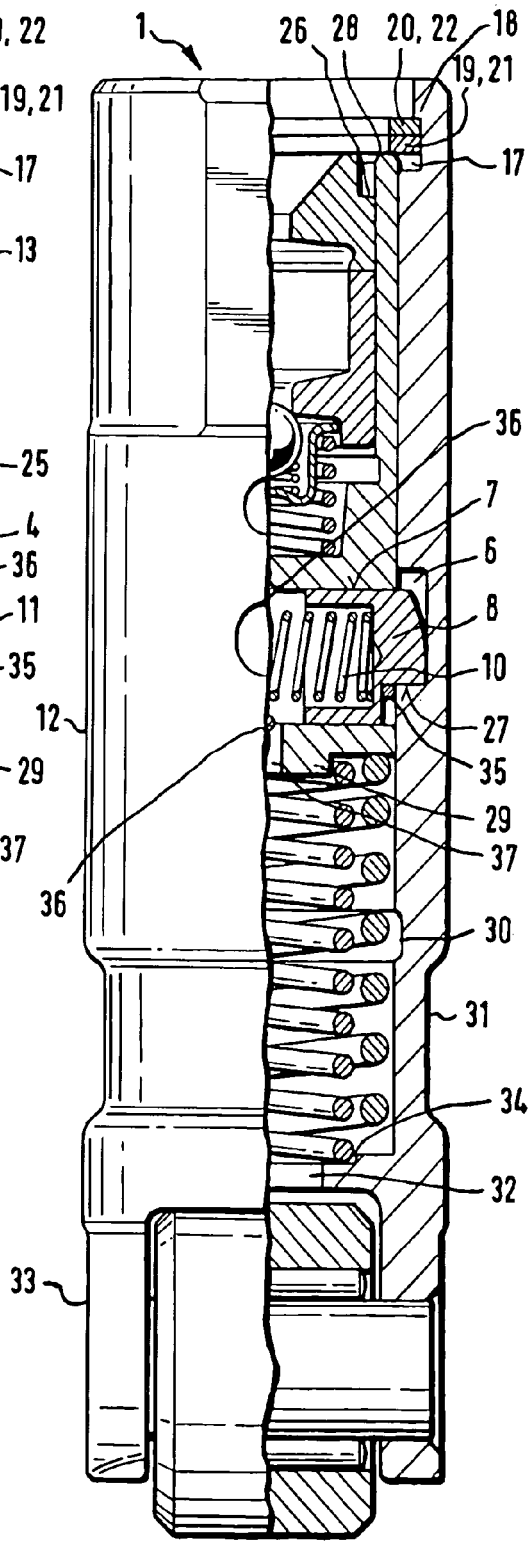
FIG. 2 shows a partial longitudinal section of the switching element of FIG. 1 rotated by 90°.

FIGS. 1 and 2 disclose a switching element 1 for a valve drive of an internal combustion engine. The switching element 1 is configured in this case as a roller tappet for a tappet push rod drive and comprises an outer part 2 having a bore 3 in which an axially movable inner element 4 extends. The inner element 4 and the outer part 2 are forced apart from each other by a lost motion spring 5, not requiring further explanation here, although in the illustrated embodiment, component 5 comprises two springs.

In the illustrated axially separated position of the outer part 2 relative to the inner element 4, the receptacles 6, 7 thereof are aligned to each other. The receptacle 6 of the outer part 2 is manufactured as a circumferential annular groove. The receptacle 7 in the inner element 4, in contrast, is designed as a radially extending through-bore. Arranged herein are two diametrically opposite coupling means 8, embodied here as pistons. As can be seen in FIG. 2, each coupling means 8 has a stepped flat for engagement with a facing lower surface 27 of the annular groove 6. An anti-rotation component 35, such as a ring, is arranged to substantially prevent rotation of the coupling means 8 about their respective axes. The coupling means 8 are forced radially outwards (coupling direction) through the force of a compression spring 10. In the radially inward direction i.e., in the uncoupling direction, the coupling means 8 can be displaced by means of hydraulic medium. For this purpose, the outer part 2 appropriately has two oil passages 11 situated diametrically opposite each other (see FIG. 1). These passages 11 are configured in the present case as bores and are offset by 90° to the coupling means 8 in the circumferential direction. In useful fashion, the oil passages 11 communicate with two hydraulic medium ducts from surrounding structure, not explained further here. A stop member 36, such as another ring, is arranged to limit the distance by which the coupling means 8 can be displaced towards each other.

It can be seen further that the inner element 4 is likewise secured against rotation relative to the outer part 2. For this purpose, an anti-rotation device 15 (embodied here as a pin) is fixed in the outer part 2 and projects radially into the bore 3 of the outer part 2. The inner element 4, in turn, has a longitudinal recess 16 facing the anti-rotation device 15 on the flanks of which the anti-rotation device 15 is guided.

According to another aspect of the invention, a further port 37 is formed in a lower portion of the inner element 4, and is in communication with the radial bore 7. Also, the inner element 4 includes a lower end defining a raised pad 29.

The outer part 2 also has a further annular groove 30 facing the bore 3. The groove 30 is disposed below the inner element 4, at least when the coupling means 8 couples the inner element 4 to the outer part 2. Also, part of an outer surface of the outer part 2, disposed proximate to a lower end of the outer part 2, forms an annular recess 31, and a lower surface of the outer part has a further bore 32 formed therethrough. The further bore 32 is in communication with the bore 3 of the outer part 2. Furthermore, a recess 34 is formed in a lower surface of the outer part 2 facing the bore 3, and the recess 34 forms a seat for receiving a lower end of at least part of the lost motion spring 5. The outer part 2 also includes at its lower end a U-shaped configuration 33 for engaging roller 14, which is adapted to engage the cam (not shown).

The outer part 2 has, in a region distant from the bore, an annular groove 17 with a stop 18. Two retaining rings 19, 20 are shaped into the annular groove 17. These rings form a second and a first upper stop 21, 22, respectively. As a whole, the retaining rings 19, 20 bear against the stop 18. The second, lower retaining ring 19 serves as an anti-loss device of a pressure piston 23 of a hydraulic lash adjuster 24 that is installed in the inner element 4. An adjustment of the coupling lash of the coupling means 8 in the surrounding receptacle 6 is achieved by means of the first retaining ring 20 that is situated on the second retaining ring 19 and is stacked in different thicknesses during assembly.

It is clear that, after installation of the second retaining ring 19, the pressure piston 23 together with the inner element 4 can no longer be pushed out of the bore 3 of the outer part 2 by the force of a compression spring 25 of the lash adjuster 24 or by the force of the lost motion spring 5. The pressure piston 23 thus bears against the second retaining ring 19 through its edge 26.

Before the coupling lash of the coupling means 8 relative to their receptacle 6 can be adjusted, it is necessary to determine this lash. This is done with the coupling means 8 extended. In doing so, to put it simply, after loading of the inner element 4 and hence its displacement in the bore 3 until a lower surface 27 of the receptacle 6 is reached, the free travel of the coupling means 8 in the receptacle 6 is measured. For a person skilled in the art it is then relatively simple to calculate, on the basis of the measured free travel, the height at which a central position of the coupling means 8 in the receptacle 6 is reached. When this value has been established, a first retaining ring 20 of appropriate thickness is snapped into the annular groove 17 directly above the second retaining ring 19. The lost motion spring 5 thus presses the inner element 4 with its edge 28 against the second retaining ring 19. In this position (coupling position), the adjustment of the coupling lash is completed, advantageously in such a manner that the coupling means 8 has an equally short traveling path in both axial directions within the receptacle 6.

To sum up, the free travel that the inner element 4 traverses relative to the outer part 2, with the coupling means 8 in the receptacles 6, after successful coupling with the outer part 2 and upon commencement of cam loading, is kept uniformly small by means of a series of switching elements 1 in internal combustion engines of the same type. Excessive and undesirable variation in valve timings is precluded.

REFERENCE NUMERALS

1 Switching element
2 Outer part
3 Bore
4 Inner element
5 Lost motion spring
6 Receptacle of outer part
7 Receptacle of inner part
8 Coupling means
9 not used
10 Compression spring
11 Oil passage
12 Outer peripheral surface
13 Means
14 Roller
15 Anti-rotation device
16 Longitudinal recess
17 Annular groove
18 Stop
19 Retaining ring
20 Retaining ring
21 Upper stop
22 Upper stop
23 Pressure piston
24 Lash adjuster
25 Compression spring
26 Edge of pressure piston
27 Lower surface
28 Edge of inner element
29 raised pad
30 Annular groove
31 Annular recess
32 Bore
33 U-shaped configuration
34 recess
35 anti-rotation component
36 stop member
37 port

What is claimed is:

1. A switching element for a valve train of an internal combustion engine, the switching element comprising:

an outer part and an inner element that is axially displaceable in a bore therein, wherein the outer part and the inner element each have at least one receptacle aligned with each other in an axially separated relative position achieved by a lost motion spring, wherein one or more movable coupling means for coupling the inner element with the outer part are applied in one of the receptacles toward the other receptacle in their positions relative to one another, wherein a first upper stop for defining the relative position is applied between the inner element and the outer part, and wherein a hydraulic lash adjuster with a pressure piston is installed in the inner element, which pressure piston is fixed against moving axially out of the inner element by a second upper stop, wherein each of the upper stops is at least one annular element forming a retaining ring and the upper stops are arranged on top of each other in the bore of the outer part, wherein as seen when looking into the bore of the outer part, a lower one of the retaining rings forms the second upper stop and a first one of the retaining rings, located above it, forms the first upper stop, wherein variable-thickness first and constant-thickness second retaining rings are provided at assembly of the retaining rings, and wherein at least part of a retaining ring stack formed by those retaining rings contacts a stop forming an annular shoulder of the bore with the first retaining ring out of the bore.

2. A switching element as set forth in claim 1, wherein as coupling means, two pistons are provided that extend in the receptacle, configured as a radial bore, in the inner element where they are situated diametrically opposite each other.

3. A switching element as set forth in claim 2, wherein the receptacle of the outer part is manufactured as an annular groove in the bore thereof and is intersected by at least one oil passage in the outer part, and wherein the inner element is guided in the bore of the outer part by an anti-rotation device.

4. A switching element as set forth in claim 3, wherein arranged as the anti-rotation device is a radially projecting element, which is fixed in one of the outer part and inner element and is guided in a longitudinal recess of another one of the inner element and outer part.

5. A switching element as set forth in claim 1, wherein the outer part has means for a rotation-proof guidance of the switching element relative to a surrounding structure.

6. A switching element as set forth in claim 5, wherein the means for rotation-proof guidance includes one or more flattened portions on an outer peripheral surface of the outer part.

7. A switching element as set forth in claim 1, wherein the switching element is a cam follower in a tappet push rod drive.

8. A switch element for a valve drive of an internal combustion engine, the switch element comprising:

an outer part having a bore therein and an annular groove facing the bore;

an inner element axially movable in the bore, the inner element having a radial bore and being adapted to receive a hydraulic element having an associated pressure element;

a lost-motion spring biasing one of the outer part and inner element with respect to another one of the outer part and inner element;

opposed couplers in the radial bore, to be displaced at least partially into the annular groove to couple the inner element to the outer part, the couplers each having a lower surface to contact an inner surface of the outer part adjacent the annular groove; and a plurality of upper stops, including at least a first upper stop arranged to define a relative position of the inner element with respect to the outer part, and a second upper stop arranged to substantially prevent the pressure element from moving out of the inner element, wherein the outer part has at least one oil port, at least some of the upper stops are arranged to contact each other, and at least one of the upper stops has a thickness selected to yield a predetermined amount of mechanical lash within the switch element.

9. A switch element as set forth in claim 8, further comprising an anti-rotation safety element arranged to substantially prevent the inner element from rotating with respect to the outer part.

10. A switch element as set forth in claim 9, wherein the anti-rotation safety element is fixed to one of the outer part and inner element.

11. A switch element as set forth in claim 10, wherein the anti-rotation safety element projects in a recess of another one of the outer part and inner element.

12. A switch element as set forth in claim 8, wherein the outer part also has at least one anti-rotation component providing anti-rotation guidance of the switch element relative to a surrounding structure.

13. A switch element as set forth in claim 12, wherein the at least one anti-rotation component is formed by one or more substantially flat outer surfaces of the outer part.

14. A switch element as set forth in claim 8, further comprising a roller adjacent to the outer part as a cam follower.

15. A switch element as set forth in claim 8, wherein the at least one oil port includes diametrically opposed oil ports offset in a circumferential direction from the couplers.

16. A switch element as set forth in claim 8, wherein the lower surface of each coupler is substantially planar.

17. A switch element as set forth in claim 16, wherein each coupler comprises a piston having an end, and at least part of the end is curved in shape.

18. A switch element according to claim 8, wherein at least one of the upper stops includes an annular element.

19. A switch element according to claim 8, wherein the upper stops are arranged on top of each other in the bore.

20. A switch element according to claim 8, wherein a further port is formed in a lower portion of the inner element, and is in communication with the radial bore.

21. A switch element according to claim 8, wherein the inner element includes a lower end defining a raised pad.

22. A switch element according to claim 8, wherein the lost-motion spring comprises at least two springs.

23. A switch element according to claim 8, wherein the outer part also has a further annular groove facing the bore and disposed below the inner element at least when the couplers couple the inner element to the outer part.

24. A switch element according to claim 8, wherein part of an outer surface of the outer part, disposed proximate to a lower end of the outer part, forms an annular recess.

25. A switch element according to claim 8, wherein a lower surface of the outer part has a further bore formed therethrough, and the further bore is in communication with the bore of the outer part.

26. A switch element according to claim 8, wherein the outer part includes a lower end having a U-shaped configuration for engaging a roller adapted to engage a cam.

27. A switch element according to claim 8, wherein a recess is formed in a lower surface of the outer part facing the bore, and the recess forms a seat for receiving a lower part of the lost-motion spring.

28. A switch element according to claim 8, wherein each of the couplers has a stepped flat for engagement with the inner surface of the outer part adjacent the annular groove.

29. A switch element according to claim 8, wherein the at least one oil port includes at least two diametrically opposed oil ports offset in a circumferential direction from the couplers.

30. A switch element according to claim 8, further comprising an anti-rotation component arranged to substantially prevent rotation of the couplers.

31. A switch element according to claim 8, further comprising a spring biasing the couplers away from each other.

32. A switch element according to claim 8, further comprising a stop member arranged to limit displacement of the couplers towards each other.

* * * * *